US008100730B2

(12) United States Patent
Hara et al.

(10) Patent No.: US 8,100,730 B2
(45) Date of Patent: Jan. 24, 2012

(54) JOINT CONNECTOR AND WIRING HARNESS

(75) Inventors: Teruo Hara, Yokkaichi (JP); Yuujirou Imai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/917,698

(22) Filed: Nov. 2, 2010

(65) Prior Publication Data

US 2011/0111640 A1 May 12, 2011

(30) Foreign Application Priority Data

Nov. 10, 2009 (JP) ..... 2009-257011

(51) Int. Cl.
*H01R 9/22* (2006.01)

(52) U.S. Cl. ..... 439/721; 439/722; 439/752.5; 439/92

(58) Field of Classification Search ..... 439/721, 439/722, 752.5, 92
See application file for complete search history.

(56) References Cited

U.S. PATENT DOCUMENTS 6,217,394 B1 * 4/2001 Sugie ..... 439/752.5
6,840,820 B2 * 1/2005 Oda ..... 439/724
2006/0128185 A1 * 6/2006 Nakazawa et al. ..... 439/92
2010/0071953 A1 * 3/2010 Ichio et al. ..... 174/72 A

FOREIGN PATENT DOCUMENTS

JP 2000-77140 3/2000

* cited by examiner

*Primary Examiner* — Hien Vu
(74) *Attorney, Agent, or Firm* — Gerald E. Hespos; Michael J. Porco

(57) ABSTRACT

A ground joint connector (JC) has a housing (20) with cavities (21) for receiving female terminals (11). The ground joint connector (JC) also has a joint terminal (50) including a male terminal portion (51) with male terminals (55) to be accommodated in the respective cavities (21). A bracket (52) is connected with the male terminal portion (51) and includes a mounting portion (65) to be mounted on a grounding portion. The bracket (52) extends in an extending direction of the cavities (21) from the rear edge of the male terminal portion (51) and then is bent twice to define a crank shape. Reinforcing flanges (73) and ribs (75) are formed on a flat portion at a base end side of the bracket (52). The housing (20) includes receiving portions (46, 47) for tightly holding back ends of the flanges (73) and the ribs (75).

12 Claims, 17 Drawing Sheets

JOINT CONNECTOR AND WIRING HARNESS

BACKGROUND OF THE INVENTION

1. Field of the Invention

The invention relates to a ground joint connector and a wiring harness using this joint connector.

2. Description of the Related Art

Japanese Unexamined Patent Publication No. 2000-77140 discloses a joint connector for connecting plural ground wires to a grounding portion of a vehicle at once. This connector has a housing with side by side cavities for receiving female terminals connected to ends of the ground wires. A joint terminal is to be mounted in the housing. The joint terminal has a male terminal portion with male terminals to be accommodated in the respective cavities. Base ends of the male terminals are connected to each other. An L-shaped bracket is connected to the rear of the male terminal portion. A leading end of the bracket has a flat mounting portion formed with a mounting hole.

The female terminals connected to the ends of the ground wires are inserted into the respective cavities of the housing having the joint terminal mounted therein to connect the corresponding pairs of female and male terminals. A bolt stands up at the grounding portion and is inserted into the mounting hole in the mounting portion of the bracket of the joint terminal. A nut is tightened onto the bolt to closely fix the mounting portion to the grounding portion so that the respective ground wires are grounded at once.

The mounted position of the joint connector is subject to vibration and the housing is likely to be shaken when the vehicle is running. Thus, reinforcing beads are formed to increase the strength of the bent part of the bracket bent into the L-shape.

The housing may have to be distant from the grounding portion to mount this type of joint connector on the grounding portion of the vehicle due to a restriction on an arrangement space. In such cases a vertical leg of the bracket may be extended. However, a bending force acts on the joint between the base end of the leg and the rear edge of the male terminal portion when the connector is subject to vibration, and the longer leg might break. Therefore, a countermeasure would be well received.

The invention was developed in view of the above situation and an object thereof is to increase a bending strength of a joint part between a male terminal portion and a bracket in a joint terminal.

SUMMARY OF THE INVENTION

The invention relates to a joint connector with a housing that has cavities for receiving female terminals. The joint connector also has a joint terminal to be mounted in the housing. The joint terminal has a male terminal portion with male terminals to be accommodated into the respective cavities. A bracket is connected with the male terminal portion and includes a mounting portion to be mounted on a grounding portion at a height different from the height of the male terminal portion. The bracket extends from the male terminal portion in an extending direction of the cavities and then is bent at least twice to define a crank shape. The mounting portion is formed by a substantially flat portion at a leading end of the bracket. At least one reinforcing bead is formed on a flat portion at a base end side of the bracket, and the housing includes at least one receiving portion for tightly holding the reinforcing bead.

The invention also is directed to a wiring harness comprising the above-described joint connector connected to ends of a plurality of ground wires.

The base end of the reinforcing bead is provided at a joint of the bracket of the joint terminal with the rear edge of the male terminal portion, and is held tightly in the receiving portion of the housing. The receiving portion receives vibration related bending forces on the joint between the bracket and the male terminal portion, and increases a bending strength. As a result, breakage at the joint is prevented.

The reinforcing bead preferably includes a flange on a lateral edge of the flat portion at least at the base end side. The flange is press-fit into the receiving portion.

The reinforcing bead may comprise a rib formed by hammering a central part of the flat portion at the base end side. The rib is inserted closely into the receiving portion.

The male terminal portion of the joint terminal preferably is formed so that male terminal rows are arranged in a plurality of levels by folding a coupling of the respective male terminals at a lengthwise intermediate position.

Further preferably, the male terminal portion of the joint terminal is formed such that male terminal rows are arranged in a plurality of levels by folding a coupling portion of the respective male terminals at a lengthwise intermediate position.

According to the above, it is possible to increase a bending strength of a joint between a male terminal portion and a bracket of a joint terminal.

These and other objects, features and advantages of the invention will become more apparent upon reading the following detailed description of preferred embodiments and accompanying drawings.

DETAILED DESCRIPTION OF THE PREFERRED EMBODIMENTS

Figure 1:
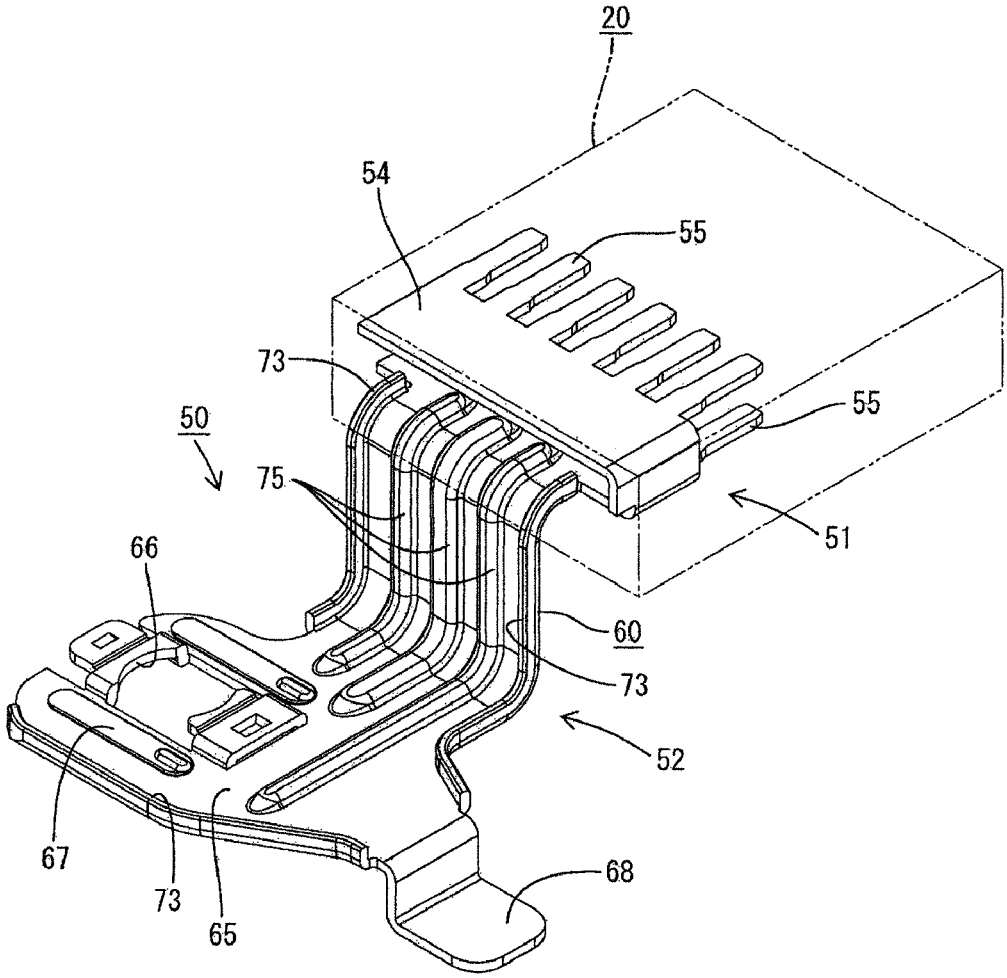
FIG. 1 is a perspective view of a joint terminal according to the invention.
Figure 8:
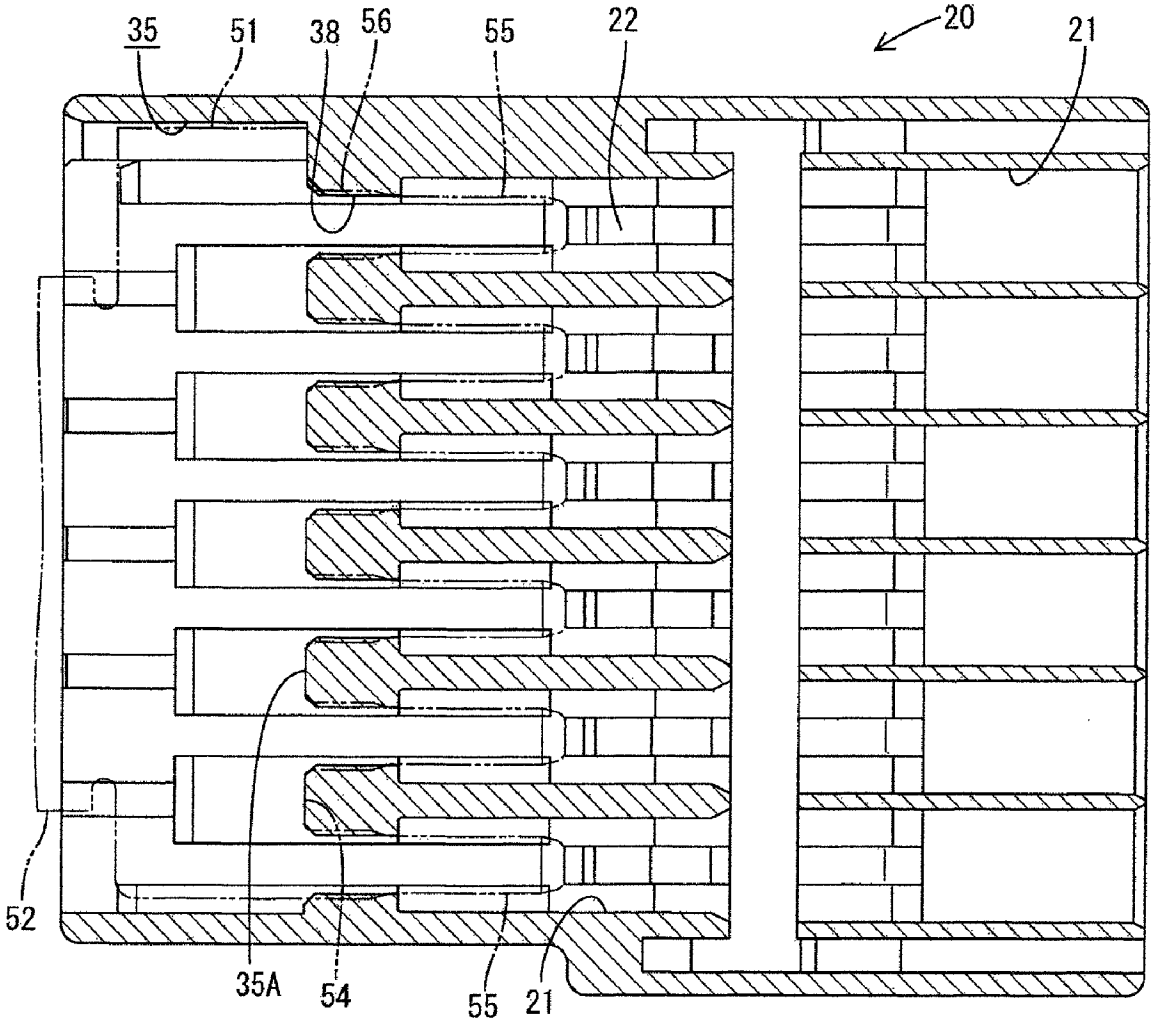
FIG. 8 is a section along VIII-VIII of FIG. 6.
Figure 9:
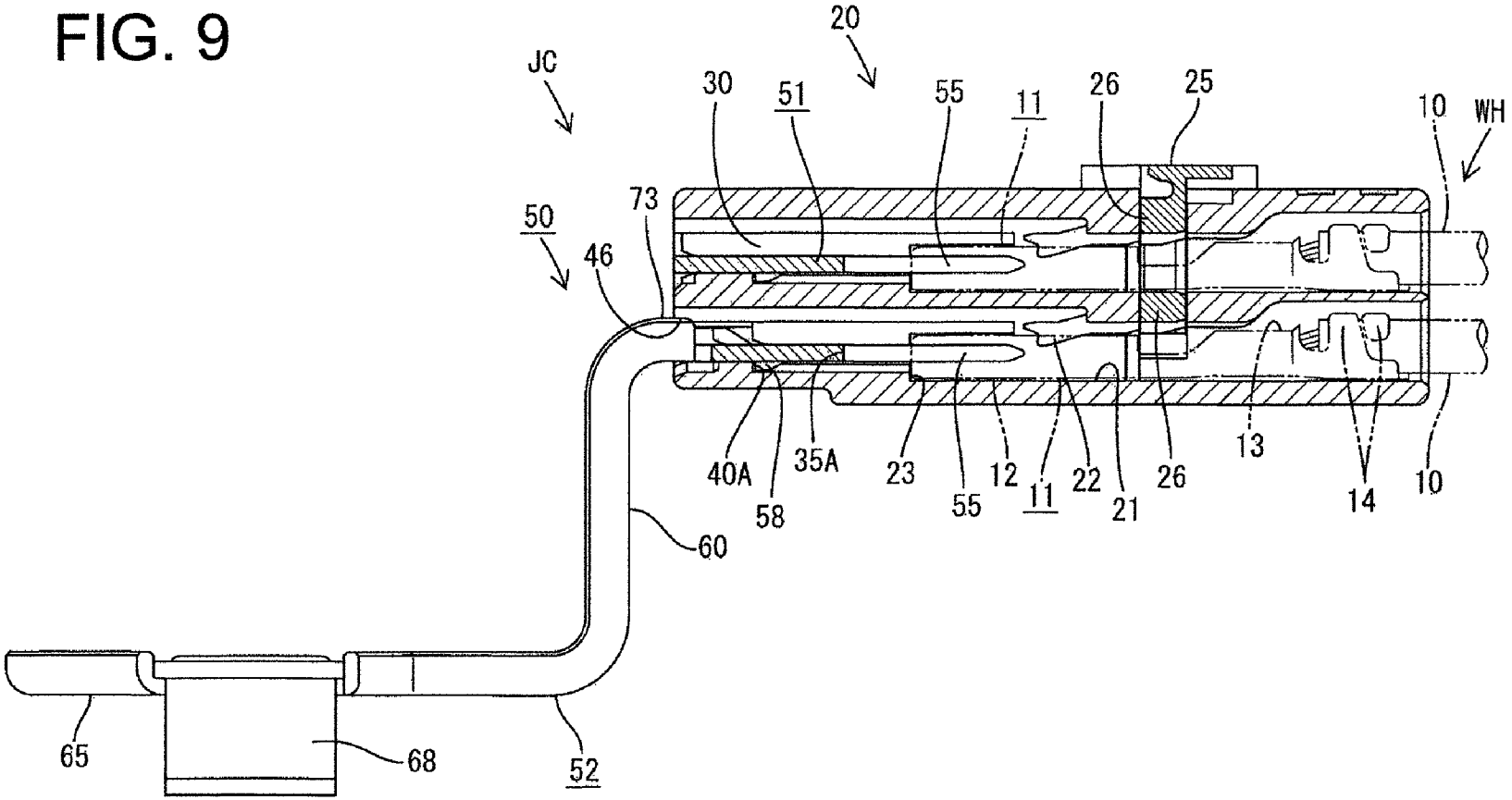
FIG. 9 is a side view in section showing a state where the joint terminal is mounted in the housing.

A joint connector in accordance with the invention is identified by the letters JC in FIGS. 1 to 18. The joint connector JC has a joint terminal 50 with a male terminal portion 51 mounted in a front end of a housing 20. Female terminals 11 connected to ends of respective ground wires 10 are mounted into the housing 20 from behind to be connected to corresponding male terminals 55 of the male terminal portion 51 as shown in FIGS. 1 and 9. The joint terminal 50 has a bracket 52 to be mounted on a grounding portion of a vehicle.

Figure 6:
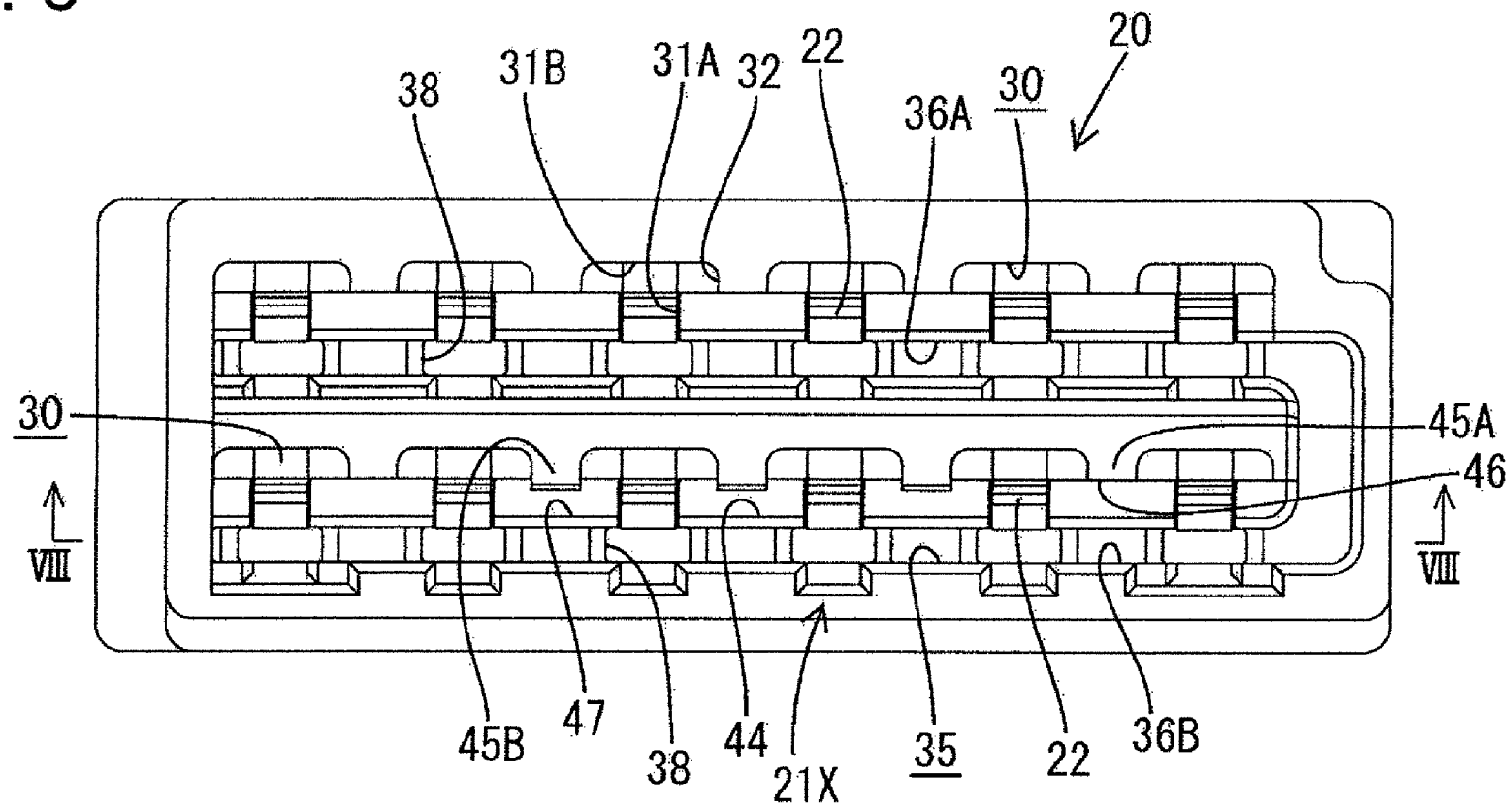
FIG. 6 is a front view of a housing.
Figure 7:
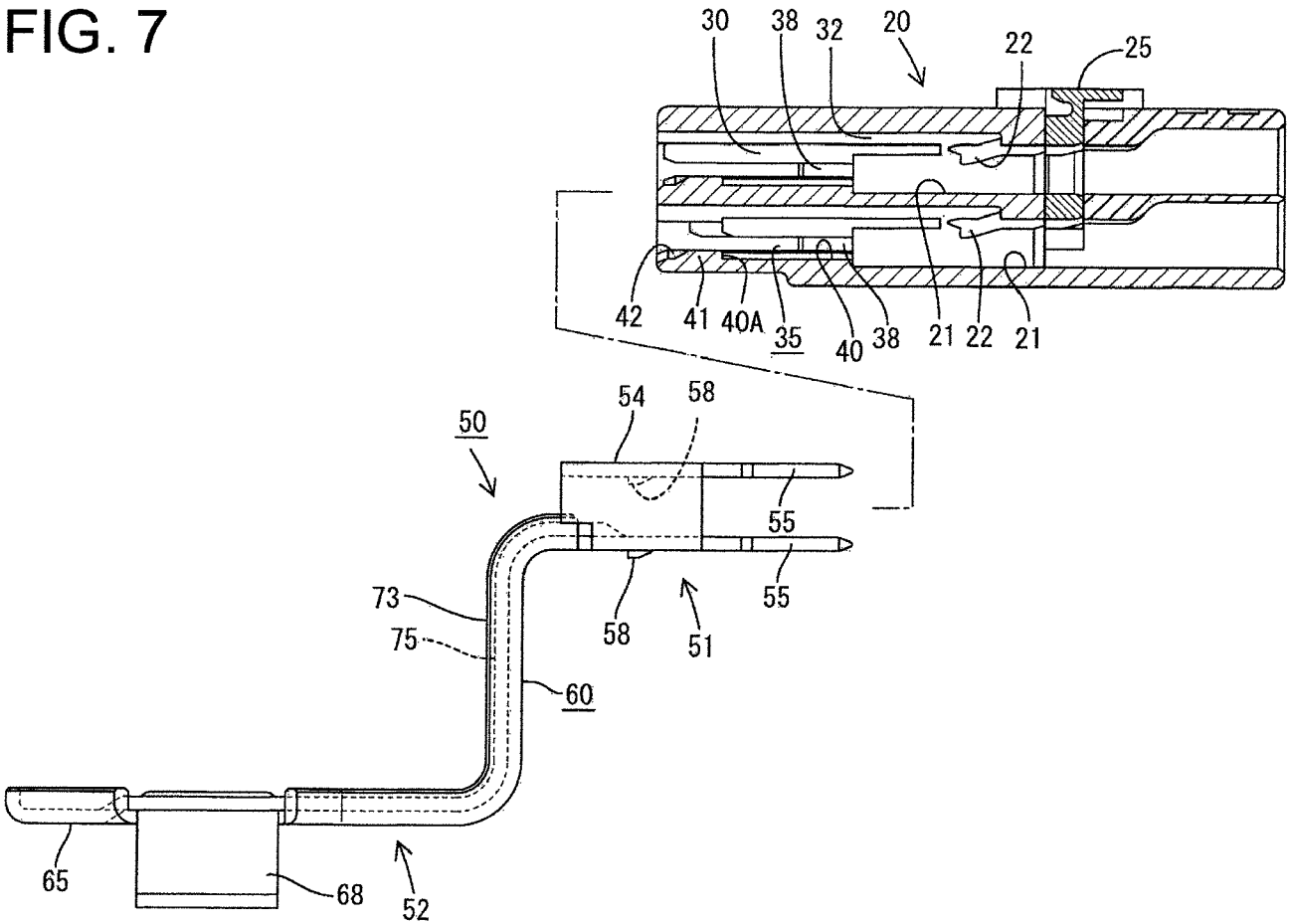
FIG. 7 is a side view partly in section showing an operation of mounting the joint terminal into the housing.

The housing 20 is made e.g. of synthetic resin and is in the form of a substantially flat block, as shown in FIGS. 6 and 7. A front end (left in FIG. 7) defines a mounting area for the male terminal portion 51 of the joint terminal 50, whereas a rear defines a mounting area for the female terminals 11. Six cavities are formed substantially side by side in a width direction in each of upper and lower levels and the female terminals 11 are insertable into the cavities from behind. A resiliently deformable locking lance 22 is provided at the ceiling surface of each cavity 21.

As shown in FIG. 9, each female terminal 11 has wire connection barrels 13, 14 provided behind a rectangular tubular connecting portion 12 that can receive the male terminal 55 of the joint terminal 50. The wire connection barrels 13, 14 are crimped and connected to the end of the ground wire 10. The female terminal 11 is inserted into the cavity 21 from behind and pushed to a proper position while resiliently deforming the locking lance 22. The locking lance 22 resiliently returns when the female terminal 11 contacts a front wall 23 and hence the locking lance 22 fits into a lock hole in the upper surface of the connecting portion 12. Thus, the female terminal 11 is locked primarily and retained. A side-type retainer 25 is mounted on the upper surface of the housing 20. The retainer 25 is pushed to a full locking position so that locking sections 26 secondarily lock the rear edges of the connecting portions 12 of the female terminals 11. Thus, the female terminals 11 are locked doubly.

Figure 2:
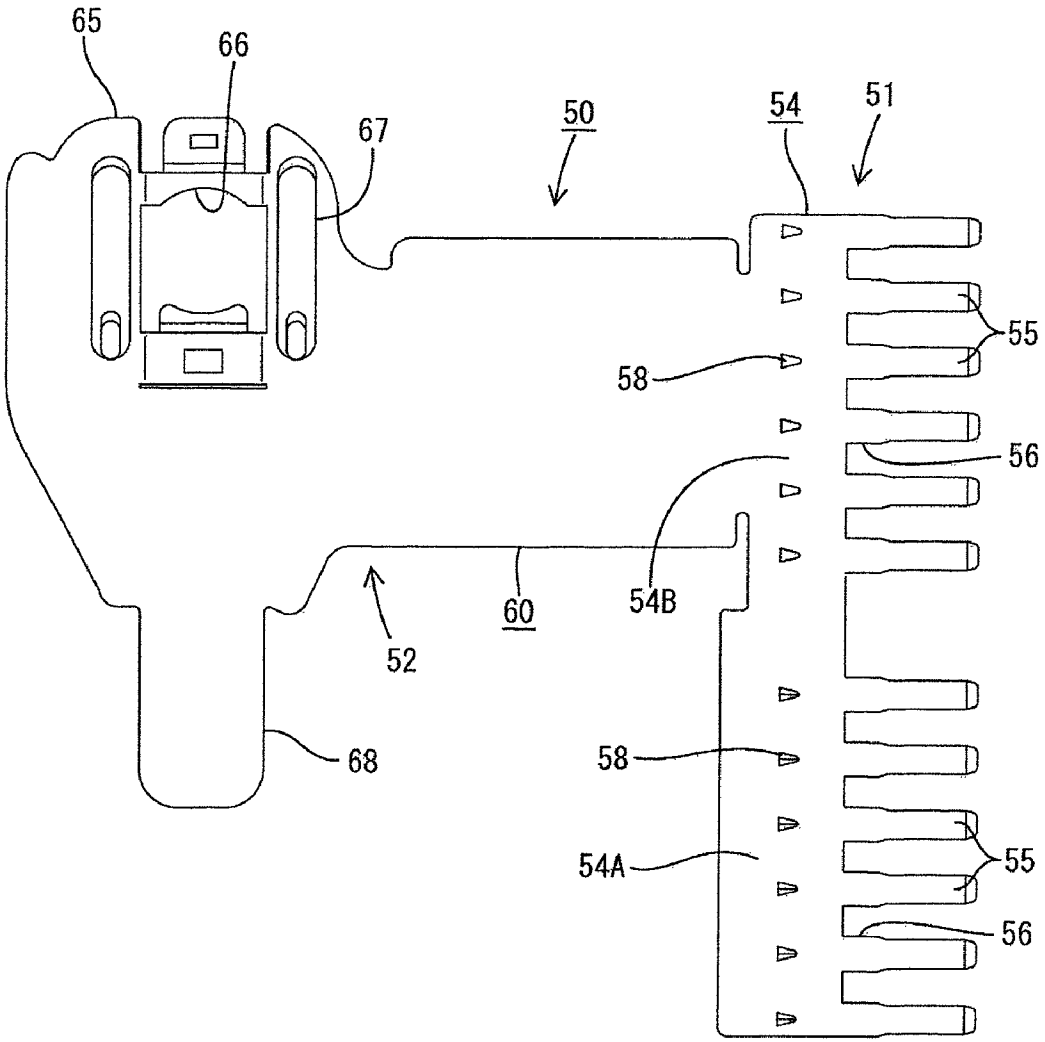
FIG. 2 is a development view of the joint terminal.
Figure 3:
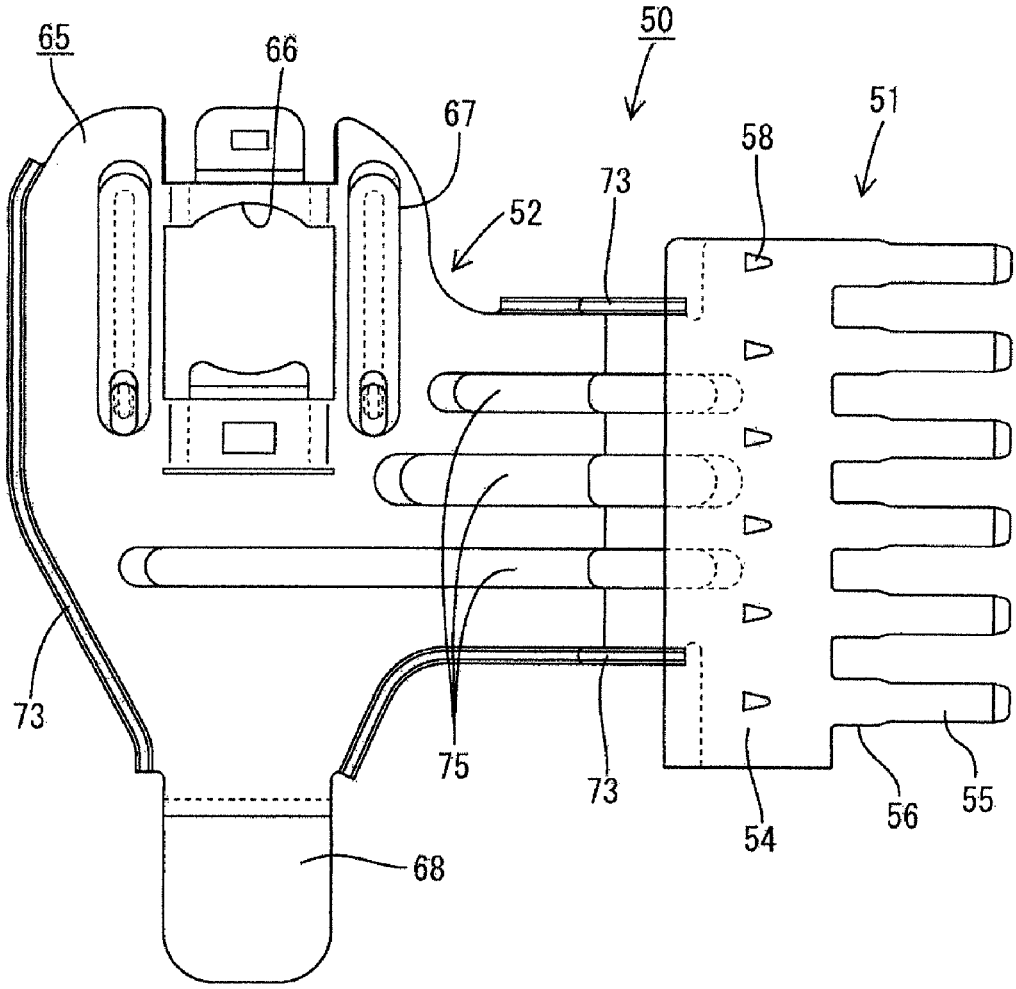
FIG. 3 is a plan view of the joint terminal.
Figure 4:
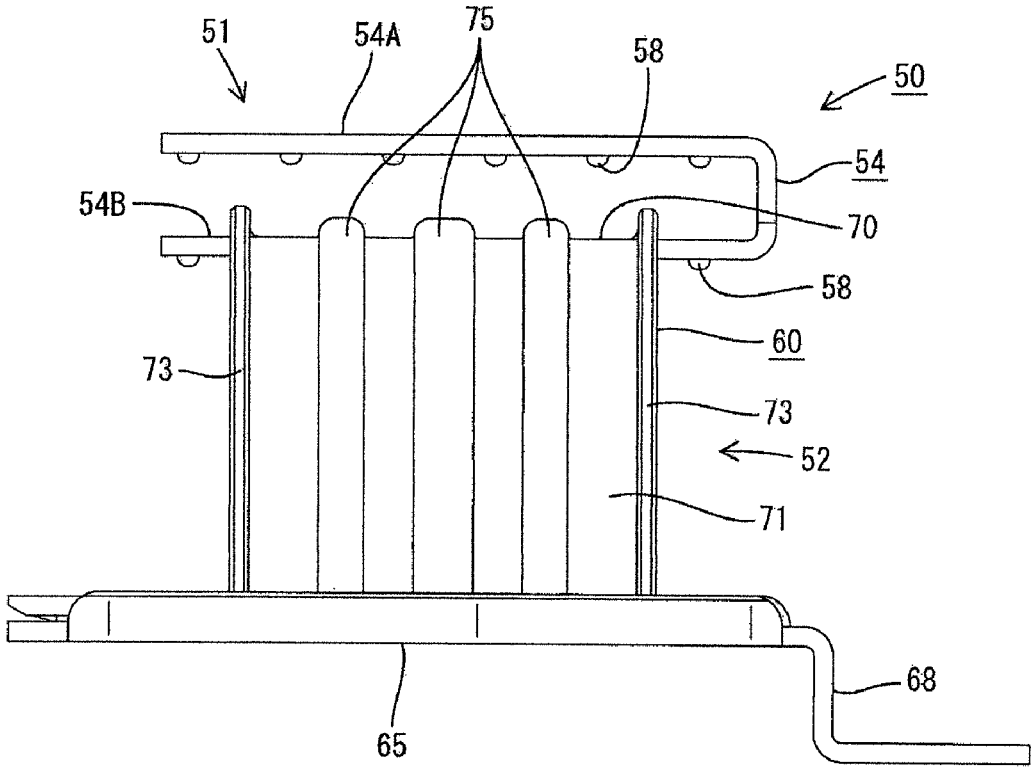
FIG. 4 is a front view of the joint terminal.
Figure 5:
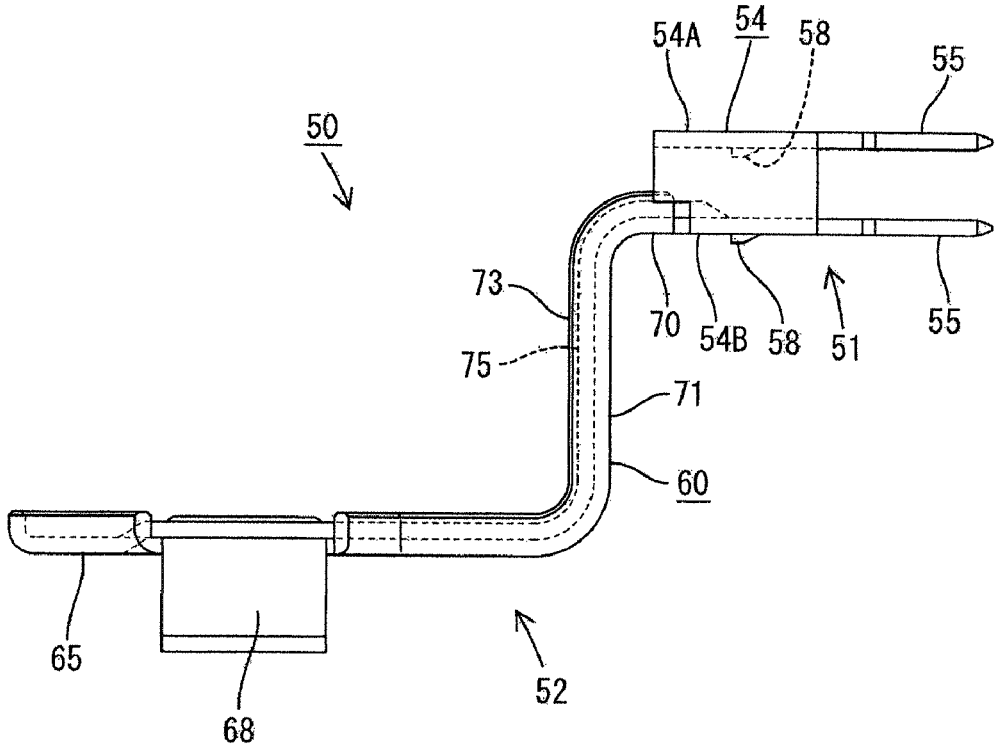
FIG. 5 is a side view of the joint terminal.

The joint terminal 50 is formed by punching or cutting out a conductive metal plate into a developed shape shown in FIG. 2. Bending, folding and/or embossing then is applied to form the joint terminal 50 with a male terminal portion 51 and a bracket 52 connected to the rear edge of the male terminal portion 51 as shown in FIGS. 3 to 5. The bracket 52 is mounted on a grounding portion of the vehicle (not shown).

The male terminal portion 51 has a wide strip shaped coupling 54. The coupling 54 is divided into left and right areas in a width direction, and six tab-shaped male terminals 55 project at substantially regular intervals from the front edge of each of the left and right parts, as shown in FIG. 2. The arrangement interval of the male terminals 55 is the same as the arrangement interval of the cavities 21 of the housing 20. The leading end of each male terminal 55 is tapered for guiding and a widened press-fitting portion 56 is defined along a specified length area (about ¼ length area) at the base end of each male terminal 55.

The male terminal portion 51 is folded by 180° at a widthwise intermediate part of the coupling 54 so that the lower part in FIG. 2 is folded to be spaced above the other part by substantially the same distance as the interval between the upper and lower cavities 21 in the housing 20. Accordingly, the bent male terminal portion 51 has six male terminals 55 in each of upper and lower levels in an arrangement conforming to the cavities 21. The coupling 54 defines a flat channel that opens laterally and the male terminals 55 project forward from the front edges of upper and lower portions 54A and 54B of the coupling 54. The upper and lower portions 54A, 54B of the coupling 54 are hammered to form downward projecting locking projections 58 on backward extensions of center lines of the respective male terminals 55.

As shown in the developed state of FIG. 2, the bracket 52 extends back from a widthwise central part of the rear edge of the lower portion 54B of the coupling 54 of the male terminal portion 51. Specifically, a leg 60 is formed in a length area slightly longer than half the length of the bracket 52 at a base end side and has a constant width slightly narrower than the lower portion 54B. A mounting portion 65 is formed at a leading end and has a lateral (e.g. left) edge that bulges slightly out. A mounting hole 66 is formed in the mounting portion 65 near the bulge. An unillustrated stud bolt extends from the grounding portion of the vehicle and is insertable into the mounting hole 66. Placing portions 67 are formed at edge portions on the top side of the mounting hole 66 and can receive another ground terminal or the like. A tongue shaped rotation preventing portion 68 projects from the right edge of the mounting portion 65.

The bracket 52 is bent at a right angle at an intermediate position of the leg 60 to extend down and then is bent at a joint between the leg 60 and the mounting portion 65 to extend back, as shown in FIGS. 1 and 5. Thus, the bracket 52 has a crank shape. More specifically, the bracket 52 is formed such that the L-shaped leg 60 has a substantially horizontal surface 70 extending back flush with the lower portion 54B of the coupling 54 and a substantially downward extending vertical surface 71 continuous with the leading end of the horizontal surface 70. The mounting portion 65 projects substantially horizontally back at the bottom end of the vertical surface 70 of the leg 60. Note that the tongue of the mounting portion 65 also is bent into an L-shape to form the rotation preventing portion 68.

The front surface of the housing 20 has jig insertion grooves 30 that enable insertion of a jig 80 for individually resiliently displacing the locking lances 22 in the respective cavities 21 in an unlocking direction. Each jig insertion groove 30 is formed before the corresponding locking lance 22 and has a substantially T-shaped cross section by connecting a horizontal section 31B at the upper end of a vertical section 31A having a width equivalent to that of the locking lance 22, as shown in detail in FIG. 14. Opposite ends of the horizontal section 31B define guides 32.

Figure 16:
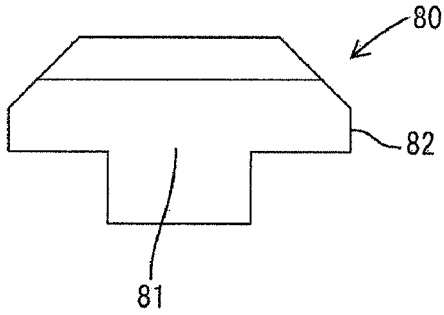
FIG. 16 is an enlarged front view of a jig.
Figure 17:
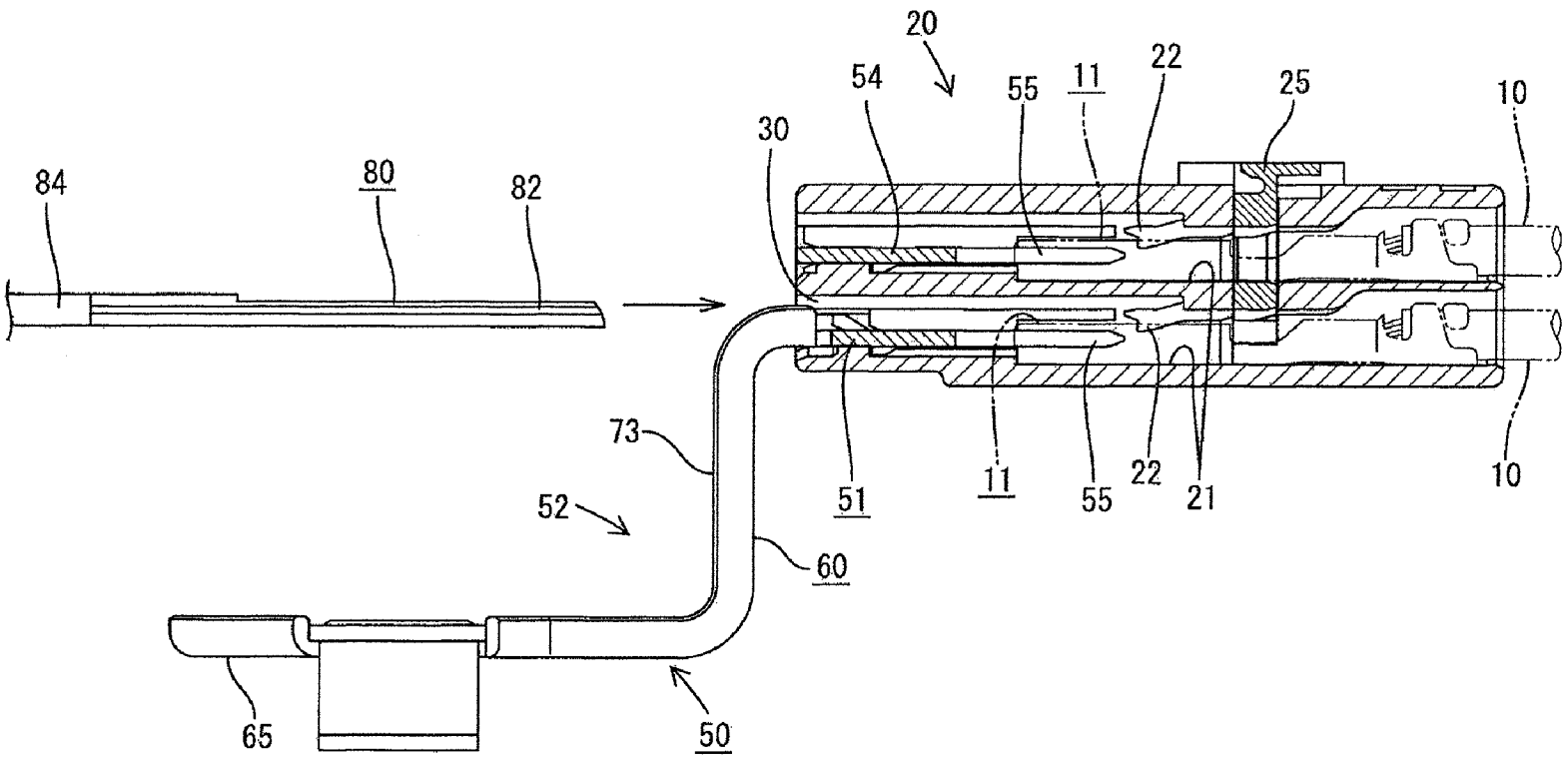
FIG. 17 is a side view partly in section showing an operation of unlocking a locking lance.

As shown in FIGS. 16 and 17, the jig 80 has a mating T-shaped cross section in conformity with the jig insertion grooves 30. A pressing portion 81 is defined at the leading end of the jig 80 for engaging and pressing the leading end of the locking lance 22. A horizontal section 82 has both ends fit into the guides 32. The jig 80 is provided at the leading end of a handle 84, so that the jig 80 can be inserted into and withdrawn from the jig insertion groove 30 by gripping the handle 84.

A terminal insertion groove 35 is formed in the front surface of the housing 20 and can receive the male terminal portion 51 of the joint terminal 50. As shown in FIG. 6, the terminal insertion groove 35 is a flat channel with an open side that conforms with the shape of the coupling 54 of the male terminal portion 51. Upper and lower groove portions 36A, 36B are formed below the cavities 21 in the respective upper and lower levels and communicate with the bottom ends of the vertical sections 31A of the jig insertion grooves 30. Further, as shown in FIG. 9, a back surface 35A of the terminal insertion groove 35 is spaced from the front surface of the housing 20 by a distance that is more than about half (e.g. at about ⅔) of a distance between the front surface of the housing 20 and the fronts of the cavities 21.

Press-fitting holes 38 extend from the back surfaces of the upper and lower groove portions 36A, 36B of the terminal insertion groove 35 to the corresponding cavities 21. The press-fitting holes 38 are slightly smaller than the press-fitting portions 56 at the base ends of the male terminals 55 so that the press-fitting portions 56 can be press-fit into the press-fitting holes 38.

Locking grooves 40 are formed right below the respective press-fitting holes 38 and extend from the front surfaces of the cavities 21 to a positions spaced rearward from the front surface of the housing 20 by a distance slightly less than ⅓ of the distance from the front surface of the housing 20 to the cavities 21. Locking surfaces 40A are formed at the front ends of the locking grooves 40 and engage the locking projections 58 on the coupling portion 54 of the joint terminal 50.

An introducing opening 42 extends into the front surface of the housing 20 before each locking groove 40 and a wall 41 is located between the introducing opening 42 and the locking groove 40.

The male terminal portion 51 of the joint terminal 50 is inserted into the terminal insertion groove 35 in the front surface of the housing 20 so that the leading ends of the respective male terminals 55 enter the corresponding terminal press-fitting holes 38 in an intermediate stage of insertion. The press-fitting portions 56 at the base ends of the male terminals 55 bite into the left and right walls of the press-fitting holes 38 at a final stage of insertion so that the male terminals 55 are press-fit. Insertion is stopped when the front edge of the coupling 54 contacts the back surface 35A of the terminal insertion groove 35, as shown in FIG. 8. In the meantime, the locking projections 58 enter through the introducing openings 42, pass the walls 41 and then fit into the locking grooves 40 to engage the locking surfaces 40A, as shown in FIG. 9, for retaining the male terminal portion 51.

At this time, the respective male terminals 55 of the male terminal portion 51 project a specified distance into the corresponding cavities 21 and are accommodated in a standby state. Further, the horizontal surface 70 of the leg 60 of the bracket 52 is located in the width direction to correspond to an arrangement area of a cavity row 21X particularly composed of the four middle cavities 21 in the lower level. The opposite left and right edges of the horizontal surface 70 are at partition parts between the cavities at the opposite ends of the cavity row 21X and the outermost cavities 21.

The bracket 52 is formed with reinforcing beads. First reinforcing beads are flanges 73 formed by bending end edges of the bracket 52 up at a substantially right angle toward the top to have a predetermined height. The flanges 73 are at three positions, namely: on the left edge of the leg 60 from the horizontal surface 70 to the vertical surface 71; in an area extending from the right edge of the leg 60 from the horizontal surface 70 to the vertical surface 71 and continuing to the rear end edge of the rotation preventing portion 68; and on the front edge of the mounting portion 65. Significantly, the flanges 73 on the left and right edges of the horizontal surface 70 of the leg 60 are deviated out from the respective jig insertion grooves 30 formed in correspondence with the cavities 21 at the opposite ends of the four-cavity row 21X.

Second reinforcing beads are ribs 75 formed by hammering the leg 60 to project toward the top. In a shown example, three ribs 75 are formed in a widthwise central part of the leg 60 to extend partly to the mounting portion 65. More specifically, the respective ribs 75 correspond to partition parts between adjacent cavities 21 of the four-cavity row 21X. Base ends of the ribs 75 are at a joint between the horizontal surface 70 of the leg 60 and the coupling 54. Ends of the right and middle ribs 75 are behind the rear placing portion 67. The left rib 75 passes on the right side of the rear placing portion 67 and reaches the vicinity of the front end edge. The three ribs 75 have substantially equal heights slightly shorter than the flanges 73. However, the middle rib 75 is slightly wider than the ribs 75 at the opposite ends. A widthwise central part of the vertical surface 71 of the bracket 52 is most distant from the flanges 73 at the opposite sides and may be poor in strength if the vertical surface 71 is long. Therefore, a sufficient strength is ensured by providing the wide rib 75 at this position.

The three ribs 75 in the intermediate part of the horizontal surface 70 of the leg 60 are arranged so as not to interfere with the jig insertion grooves 30 on the opposite sides at the respective positions between the adjacent cavities 21 of the four-cavity row 21X.

Fitting recesses 44 are formed at positions right above the lower groove portion 36B of the terminal insertion groove 35 in the front surface of the housing 20, i.e. at positions corresponding to height areas of the vertical sections 31A of the jig insertion grooves 30 in the lower level. Base ends of the flanges 73 and the ribs 75 on the horizontal surface 70 of the leg 60 are insertable into the fitting recesses 44. Back surfaces of the fitting recesses 44 align with the locking surfaces 40A of the locking grooves 40.

The ceiling surfaces of the fitting recesses 44 have a predetermined width only at the positions where the flanges 73 and the ribs 75 are fit, as shown in FIG. 6, due to the horizontal sections 31B of the jig insertion grooves 30 in the lower level. Receiving portions 46 are formed between ceilings 45A at the opposite ends of left five ceiling portions and the bottom surfaces of the corresponding fitting recesses 44 and can receive the flanges 73. The ceiling portions 45A are slightly lower than the heights of the flanges 73. Thus, the flanges 73 are inserted into the receiving portions 46 while slightly biting into the ceiling surfaces, i.e. press-fitted.

Receiving portions 47 are formed between three middle ceiling portions 45B and the bottom surfaces of the corresponding fitting recesses 44 for receiving the ribs 75. Heights of the ceiling surfaces in the ceiling portions 45B substantially equal the heights of the ribs 75. Therefore the ribs 75 are inserted closely into the receiving portions 47.

As shown in FIG. 7, the joint terminal 50 is mounted from the front into the housing 20 while the retainer 25 is at a partial locking position. Specifically, the male terminal portion 51 of the joint terminal 50 is inserted into the terminal insertion groove 35 in the front surface of the housing 20 so that the male terminals 55 enter the cavities 21 and are press-fit into the terminal press-fitting holes 38. Insertion is stopped when the front edge of the coupling 54 of the male terminal portion 51 contacts the back surface 35A of the terminal insertion groove 35, as shown in FIG. 8. At this time, as shown in FIG. 9, the locking projections 58 enter the corresponding locking grooves 40 and engage the locking surfaces 40A to retain the male terminal portion 51. The respective male terminals 55 of the male terminal portion 51 are accommodated in the standby state while projecting the predetermined distance into the corresponding cavities 21 from the front.

Figure 10:
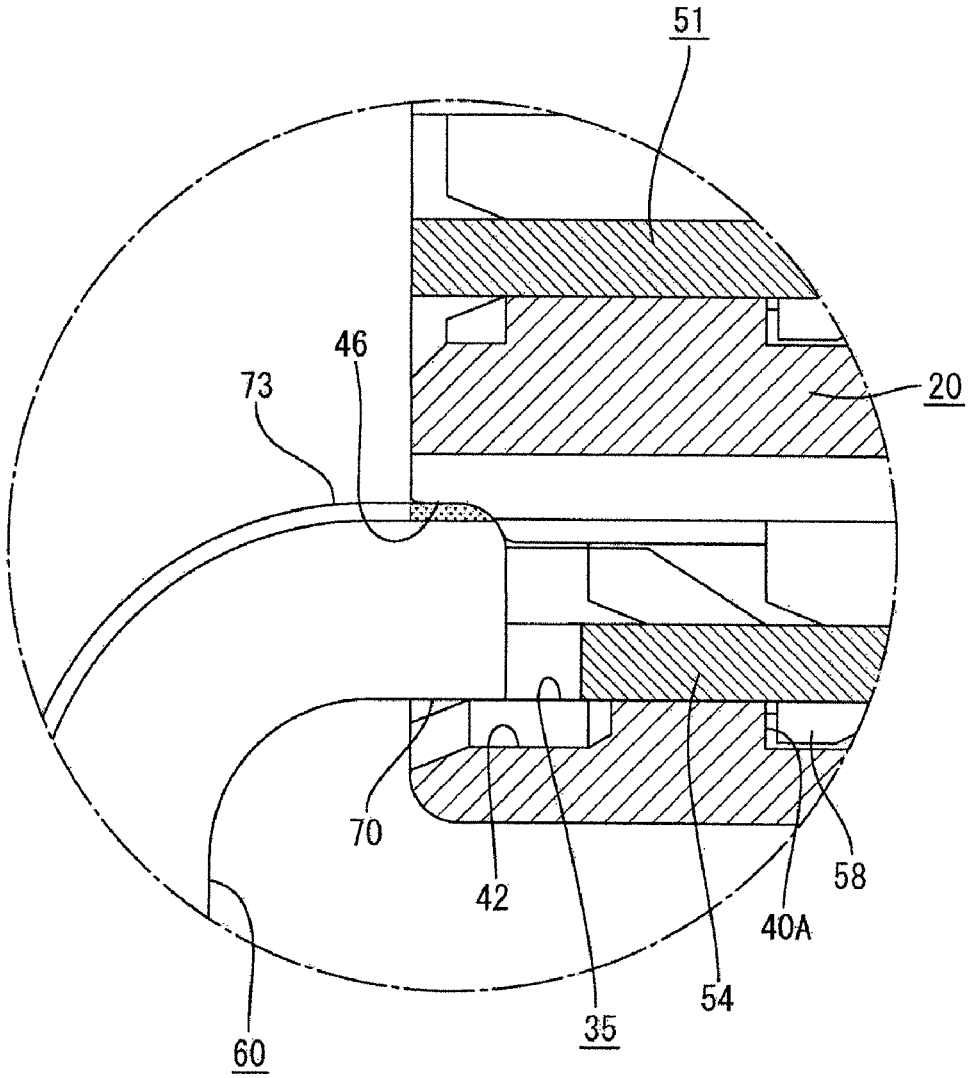
FIG. 10 is a partial enlarged view of FIG. 9.
Figure 11:
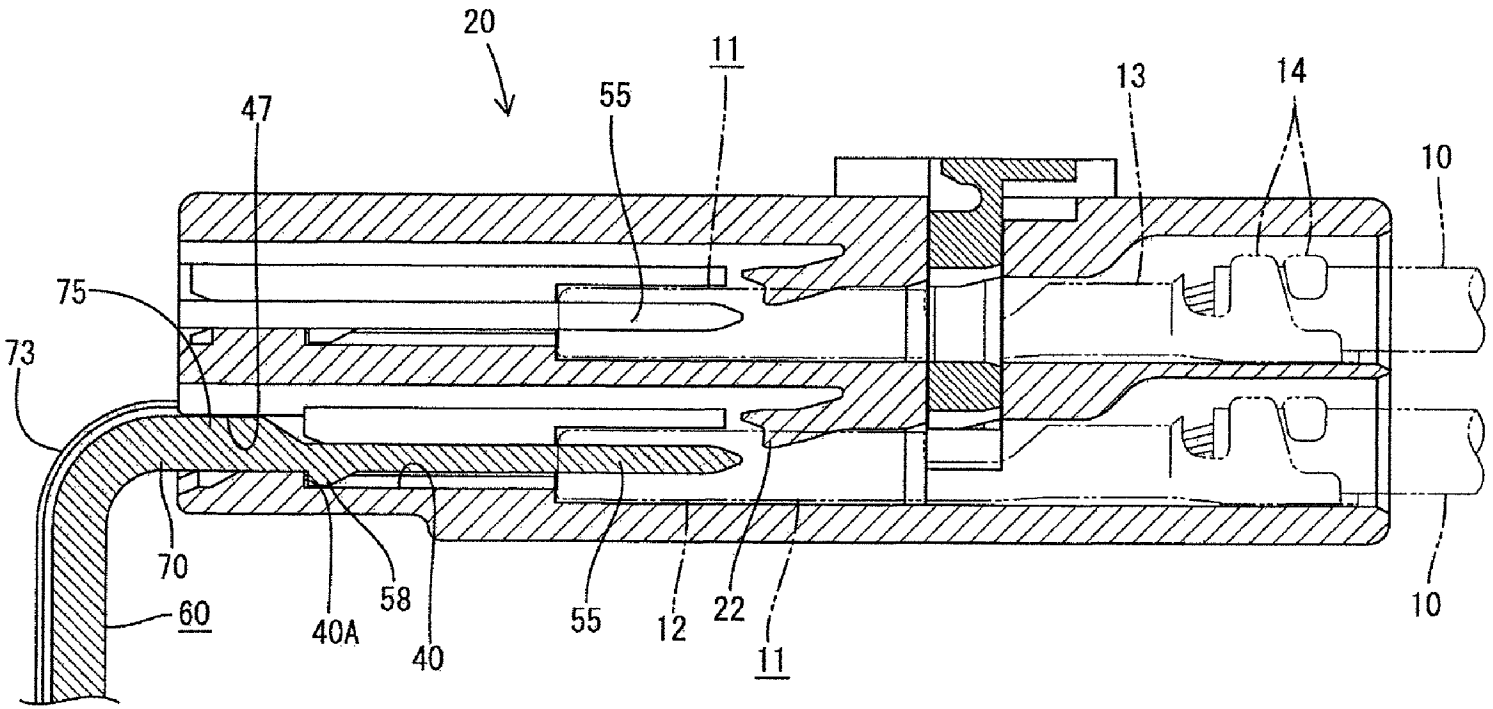
FIG. 11 is a side view in section showing a structure of a part tightly holding ribs in the state where the joint terminal is mounted in the housing.
Figure 12:
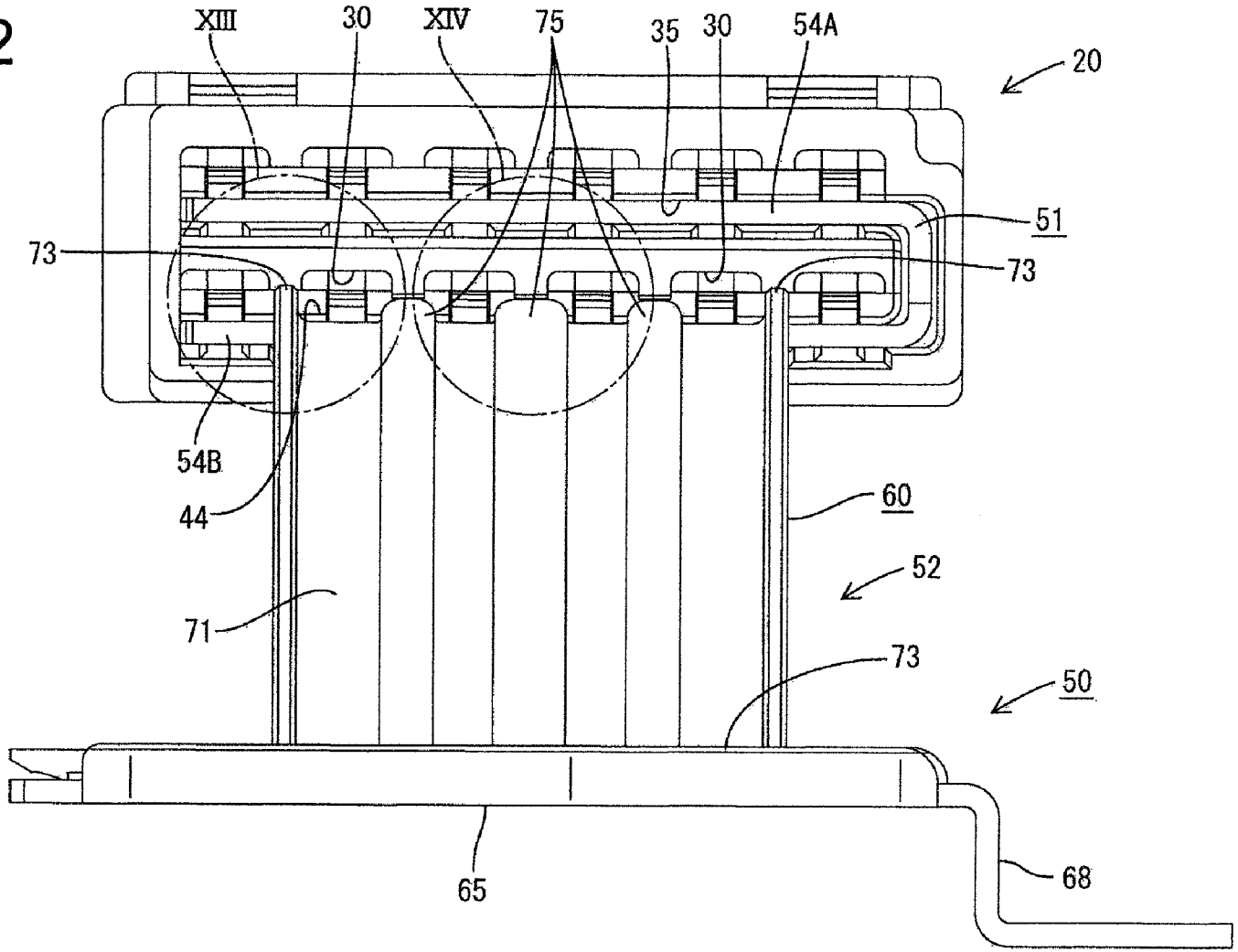
FIG. 12 is a front view showing the state where the joint terminal is mounted in the housing.
Figure 13:
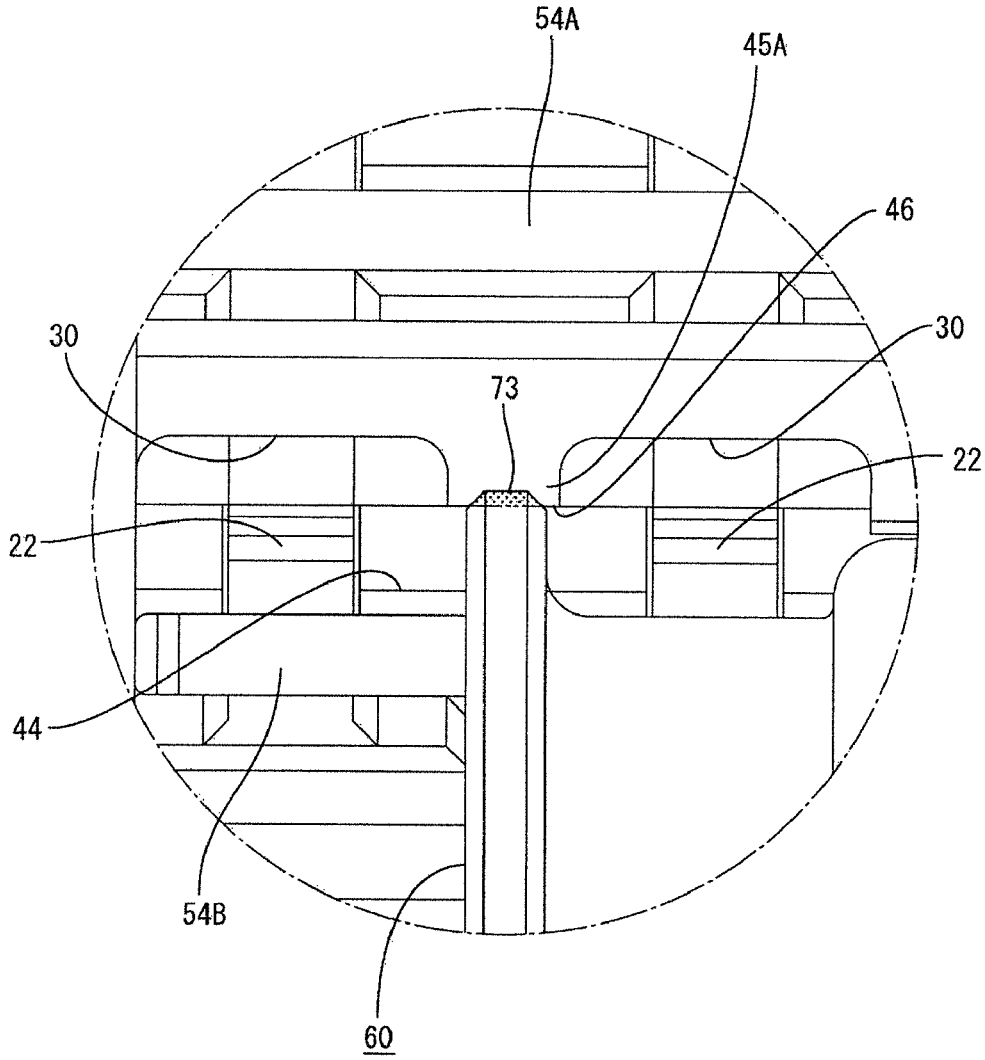
FIG. 13 is an enlarged view of an area XIII in FIG. 12.
Figure 14:
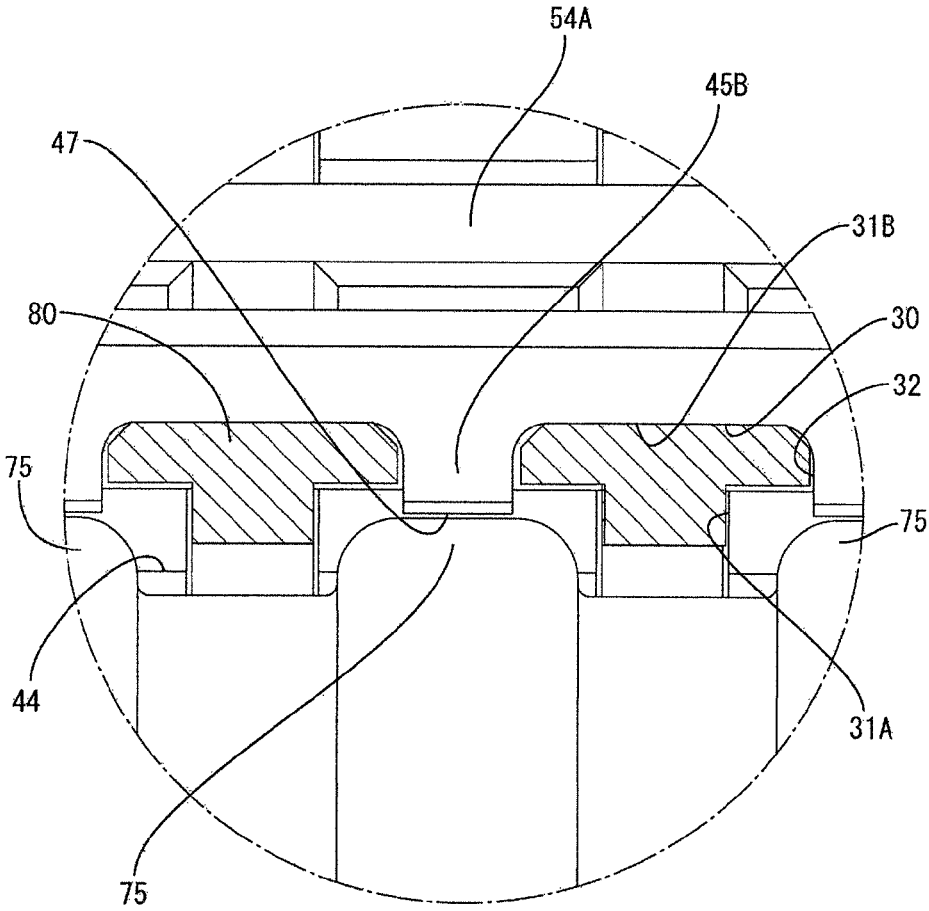
FIG. 14 is an enlarged view of an area XIV in FIG. 12.
Figure 15:
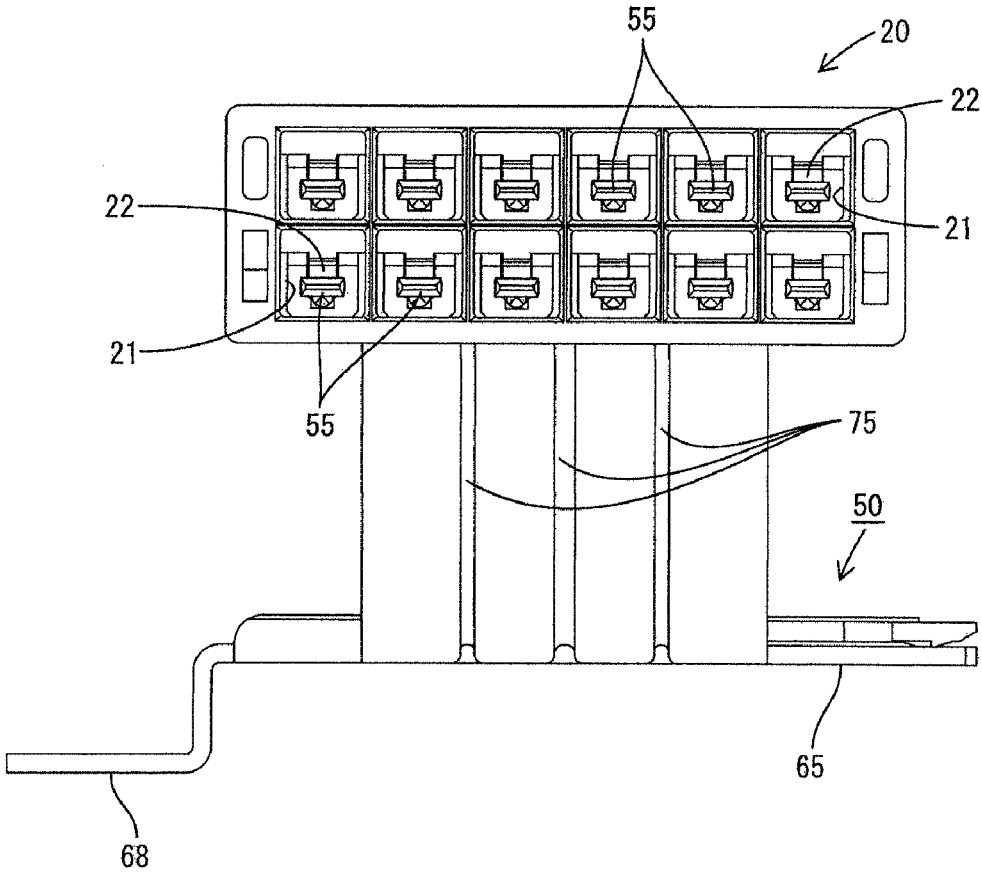
FIG. 15 is a rear view showing the state where the joint terminal is mounted in the housing.

During this time, the base end of the horizontal surface 70 of the leg 60 of the bracket 52 is fit into the fitting recesses 44, as shown in FIG. 12. Particularly, the flanges 73 at the opposite widthwise ends are press-fit into front areas of the receiving portions 46 for the flanges 73, as shown in FIGS. 9, 10 and 13, and the three ribs 75 in the widthwise central part are inserted closely to the back ends of the receiving portions 47 for the ribs 75 as shown in FIGS. 11 and 14.

The female terminals 11 fixed to the ends of the ground wires 10 of the wiring harness WH are inserted from behind into the corresponding cavities 21 of the housing 20 that have had the joint terminal 50 assembled beforehand, as described above. Each female terminal 11 is pressed to displace the locking lance 22. Accordingly, the mating male terminal 55 in the standby state enters the connecting portion 12 from front. The locking lance 22 returns resiliently to fit into the lock hole when the female terminal 11 is pushed to a proper position, as shown by chain line in FIG. 9, and locks the female terminal 11. Simultaneously, the female and male terminals 11, 55 are connected properly since the male terminal 55 is inserted to a proper depth into the connecting portion 12. When all the female terminals 11 are inserted properly, the retainer 25 is pushed to the engaging position to lock the respective female terminals 11 doubly. In this way, the joint connector JC is connected to the end of the ground wiring harness.

The joint connector JC connected to the end of the wiring harness WH is mounted on the grounding portion of the vehicle. More specifically, the stud bolt standing from the grounding portion is inserted into the mounting hole 66 in the mounting portion 65 of the bracket 52 of the joint terminal 50 projecting forward from the housing 20. The nut is tightened onto this stud bolt and fixes the mounting portion 65 closely to the grounding portion. At this time, the rotation preventing portion 68 engages the grounding portion so that the nut can be tightened without the mounting portion 65 following a rotating movement of the nut. In this way, the ground wires 10 are grounded at once.

Other ground wires also can be grounded by placing and connecting a ground terminal at ends of the other ground wires on the placing portions 67.

In the joint connector JC of this embodiment, the leg 60 of the bracket 52 of the joint terminal 50 has a relatively large height and the housing 20 is connected at the upper end of the leg 60. Thus, a bending force is likely to act on a joint between the base end of the leg 60 and rear edge of the male terminal portion 51, such as when the joint connector JC is subject to vibration or the like while the vehicle is running. However, the flanges 73 and the ribs 75 are provided at the base end of the horizontal surface 70, which is the base end of the leg 60, and are press-fit into the corresponding receiving portions 46, 47. Therefore the bending force is received by the receiving portions 46, 47 and a bending strength is increased.

Figure 18:
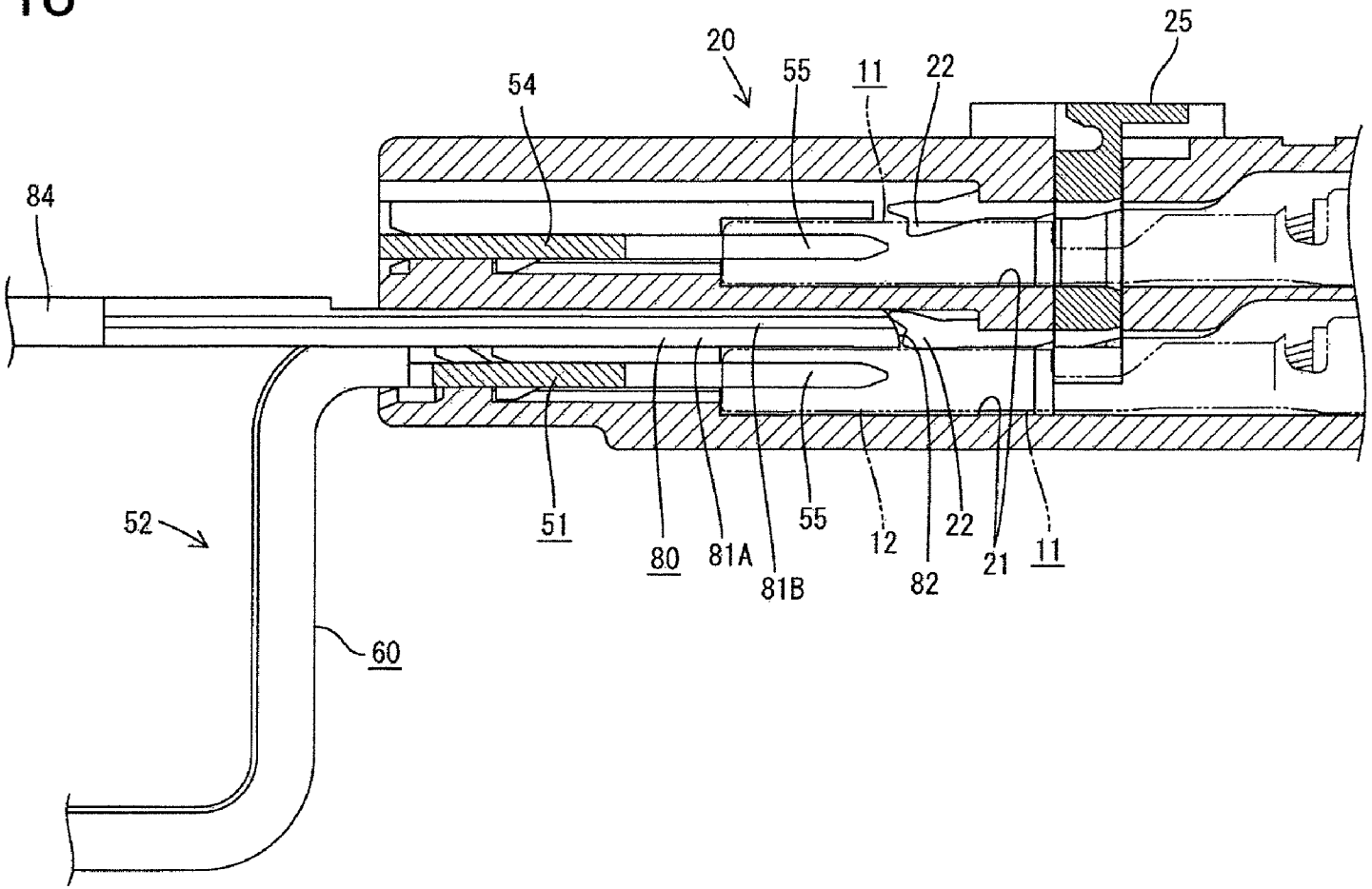
FIG. 18 is a side view in section showing a state where the locking lance is unlocked.

The female terminals 11 may be detached from the housing 20 as follows for maintenance or other purposes. First, the nut that fixes the bracket 52 of the joint terminal 50 is loosened and detached to detach the joint connector JC from the grounding portion. Subsequently, the retainer 25 mounted in the housing 20 is returned to the partial locking position and the jig 80 is inserted in a specified posture into the jig insertion groove 30, as shown in FIG. 17. Then, when the jig 80 is inserted to a predetermined depth, the pressing portion 81 at the leading end of the jig 80 presses the leading end of the locking lance 22 and displaces the locking lance 22 in the unlocking direction, as shown in FIG. 18 so that the female terminal 11 is freed from the locked state by the locking lance 22. The female terminal 11 then can be pulled backward out of the cavity 21 by gripping the corresponding ground wire 10 and pulling backward.

A distance between the grounding portion and the housing 20 is particularly long and the leg 60 of the bracket 52 is forced to have a large height. Thus, when the joint connector JC is subject to vibration while the vehicle is running, there is a high possibility that a large bending force acts on the joint between the base end of the leg 60 of the bracket 52 and the male terminal portion 51.

As a countermeasure, the leg 60 of the bracket 52 has an L-shape by including the horizontal surface 70 substantially flush with and/or extending from the rear edge of the male terminal portion 51 and the substantially downward extending vertical surface 71 continuous with the leading end of the horizontal surface 70. Additionally, the flanges 73 and the ribs 75 are formed up to the base end of the horizontal surface 70, which serves as the joint with the male terminal portion 51. The back ends of these flanges 73 and ribs 75 are held tightly by being fit into the corresponding receiving portions 46, 47 in the housing 20.

Thus, even if a bending force acts on the joint between the bracket 52 and the male terminal portion 51 due to vibration or the like as described above, the bending force is received by the receiving portions 46, 47 and a bending strength is increased. As a result, breakage or the like at the joint part can be prevented.

The invention is not limited to the above described and illustrated embodiment. For example, the following embodiments are also included in the technical scope of the present invention.

The reinforcing beads provided at the joint part between the horizontal surface of the leg portion and the rear edge of the male terminal portion in the joint terminal may be at least either the flanges provided at the lateral edges or the ribs provided in the central part.

Although the flanges and the ribs as the reinforcing beads are provided over the entire length of the leg portion including the base end of the horizontal surface in the above embodiment, they may be appropriately formed in limited places such as two bent parts of the leg portion that are thought to be subject to large bending forces.

Although the male terminals are arranged in two levels in the joint terminal in the above embodiment, they may be arranged only in one level or, conversely, arranged in three or more levels.

Although the placing portions that enable another ground terminal to be placed and assembled on the mounting portion of the joint terminal is provided in the above embodiment, such placing portions may be omitted.

Although the female terminals of the wiring harness are illustrated to be withdrawably mounted into the cavities of the housing in the above embodiment, they may not be withdrawn once being mounted.

What is claimed is:

1. A joint connector, comprising:

a housing with cavities for receiving female terminals; and a joint terminal to be mounted in the housing and including a male terminal portion with male terminals to be accommodated into the respective cavities, and a bracket connected with the male terminal portion and including a mounting portion to be mounted on a grounding portion at a height different from the male terminal portion, wherein:

the bracket extends in an extending direction of the cavities from the male terminal portion and is bent at least twice to define a crank shape, the mounting portion of the bracket being formed by a substantially flat portion at an end of the bracket remote from the male terminal portion and at least one reinforcing bead extending along the bracket from a location in proximity to the male terminal portion toward the mounting portion, the at least one reinforcing bead including at least one rib projecting from the bracket at locations spaced inward from lateral edges of the bracket, and the housing includes at least one receiving portion for tightly holding the reinforcing bead.

2. The joint connector of claim 1, wherein the at least one reinforcing bead further comprises at least one flange bent from at least one lateral edge of the bracket and being dimensioned for press-fit engagement in the receiving portion.

3. The joint connector of claim 2, wherein the rib (75) is closely engaged into the receiving portion.

4. The joint connector of claim 1, wherein the male terminal portion of the joint terminal is formed so that the male terminals are disposed in rows arranged in a plurality of levels by folding a coupling portion of the male terminal portion.

5. A wiring harness, comprising the joint connector of claim 1, female terminals in the cavities of the housing and ground wires connected to the female terminals.

6. A joint connector, comprising:

a joint terminal having opposite front and rear ends, a male terminal portion at the front end, the male terminal portion having a coupling and male terminals projecting forward from the coupling to the front end of the joint terminal, a bracket extending from the male terminal portion to the rear end of the joint terminal, a mounting portion formed on the bracket in proximity to the rear end of the joint terminal for mounting on a grounding support, first and second substantially parallel bends extending transverse to a front to rear direction and being disposed between the male terminal portion and the mounting portion so that the bracket defines a crank shape with the male terminal portion and the mounting portion being at different heights, at least one reinforcing bead extending along the bracket through the first and second bends from a location in proximity to the male terminal portion toward the mounting portion, the at least one reinforcing bead including at least one rib projecting from the bracket at locations spaced inward from the lateral edge of the bracket; and a housing with cavities receiving the male terminals and at least one receiving portion for tightly holding the reinforcing bead.

7. The joint connector of claim 6, wherein the at least one reinforcing bead further comprises at least one flange bent from a lateral edge of the bracket.

8. The joint connector of claim 6, wherein coupling is folded along fold lines transverse to the first and second bends so that the male terminals are disposed in rows arranged in a plurality of levels.

9. The joint connector of claim 6, further comprising female terminals in the cavities of the housing and engaged with the male terminals.

10. A joint terminal having opposite front and rear ends and comprising: a male terminal portion at the front end, the male terminal portion having a coupling and male terminals projecting forward from the coupling to the front end of the joint terminal, a bracket extending from the male terminal portion to the rear end of the joint terminal, a mounting portion formed on the bracket in proximity to the rear end of the joint terminal, substantially parallel bends extending transverse to a front to rear direction and being disposed between the male terminal portion and the mounting portion so that the bracket defines a crank shape with the male terminal portion and the mounting portion being at different heights, at least one reinforcing bead extending along the bracket through the bends from a location in proximity to the male terminal portion toward the mounting portion the at least one reinforcing bead including at least one rib projecting from the bracket at locations spaced inward from lateral edges of the bracket.

11. The joint terminal of claim 10, wherein the at least one reinforcing bead further comprises at least one flange bent from at least one lateral edge of the bracket.

12. The joint terminal of claim 10, wherein the coupling is folded along fold lines transverse to the bends so that the male terminals are on plural levels.

* * * * *